United States Patent [19]

Sturm

[11] 4,015,134

[45] Mar. 29, 1977

[54] APPARATUS FOR CONTROLLING THE ABSORPTION OF ONE OR MORE COLOR COMPONENTS CONTAINED IN A TEXTILE DYEING FLUID

[75] Inventor: Walter H. Sturm, Hanau, Germany

[73] Assignee: Original Hanau Quarzlampen GmbH, Hanau, Germany

[22] Filed: Mar. 31, 1976

[21] Appl. No.: 671,930

[30] Foreign Application Priority Data

Apr. 9, 1975 Germany ..... 2515499

[52] U.S. Cl. ..... 250/565; 250/576; 250/575; 250/573; 356/205; 68/15

[51] Int. Cl.[2] ..... G01N 21/28

[58] Field of Search ..... 250/238, 577, 576, 575, 250/574, 573, 564, 565; 356/204, 205, 206; 68/15

[56] References Cited

UNITED STATES PATENTS 1,002,635 9/1911 Bratkowski ..... 250/576

3,766,489 10/1973 Rosenberg et al. ..... 250/576

3,890,510 6/1975 Sturm ..... 250/565

*Primary Examiner*—Alfred E. Smith

*Assistant Examiner*—David K. Moore

*Attorney, Agent, or Firm*—Sughrue, Rothwell, Mion, Zinn & Macpeak

[57] ABSTRACT

A temperature control system for the fluid in a textile dyeing vat 10. Collimated light from a single source 18 is passed through a transparent section 14 of a shunt tube 12 coupled to the vat, and through a transparent, movable, wedge-shaped container 28 filled with a reference dyeing fluid. The emerging light intensities are detected by photocells 24, 36 whose outputs are fed to differential amplifiers 38, 40. The output of the former controls the movement of the container 28 which the output of the latter controls the temperature of the vat through a valve device 46.

10 Claims, 2 Drawing Figures

APPARATUS FOR CONTROLLING THE ABSORPTION OF ONE OR MORE COLOR COMPONENTS CONTAINED IN A TEXTILE DYEING FLUID

BACKGROUND OF THE INVENTION

1. Field of the Invention

This invention relates to a device for controlling the absorption of at least one color component contained in a dyeing fluid by regulating the temperature dependent on the transparency of the dyeing fluid, wherein the temperature is set each time at the optimum value for the absorption operation.

2. Description of the Prior Art

In a prior art device for the dyeing of textile material, a shunt circuit provided with a transparent section is connected to a dye tank. A pencil of rays penetrating this section is directed to a photo-electric receiver, the outgoing signals of which are a measure of the light transmitting quality of the dyeing fluid. In order to achieve a favorable attaching operation or absorption, the temperature is kept constant during changes in transparency, and the temperature is increased when the transparency is constant. A limit value of transparency indicates that all color components are absorbed.

In another prior art device, a pencil of rays likewise penetrates a transparent portion of a shunt circuit and is then directed to a photo-electric receiver. The outgoing signals of the latter are then transmitted to a logarithmic amplifier, so that not the transparency but rather the concentration of the dyeing fluid is determined and used for controlling the dyeing operation.

Both devices have the disadvantage that dispersion influences of the coloring substances adversely influence the measuring operation and thus the contol of the dyeing operation. Especially in light dyeing fluids, due to dispersion, the transparency and concentration are not correctly defined and the dyeing operation is adversely influenced. Complicated calibrating processes and the use of color filters are required in order to be able to reduce the errors due to such dispersion influences.

SUMMARY OF THE INVENTION

It is an object of this invention to provide an apparatus of the above mentioned kind which permits the exact control of a dyeing operation by eliminating the effects of dispersion influences.

In this invention a photo-electric receiver positioned in the path of a pencil of rays penetrating the dyeing fluid is connected to one input of two separate amplifiers, and a photo-electric receiver responsive to a pencil of rays penetrating a vessel filled with a reference fluid is connected to the other input of each amplifier. The output of the first amplifier is connected to an electric drive for moving the reference fluid vessel, and the outlet of the second amplifier is connected to an arrangement for regulating the temperature of the dyeing fluid.

This apparatus makes possible the absorption of color components existing in a dyeing fluid into textile goods independently of the dispersion of light by the particles in the dyeing fluid. To achieve this, the transparency of the dyeing fluid is compared with that of a reference fluid of the same composition, so that the dispersion influence in both fluids is of the same order and is therefore self-cancelling.

Since the absorption operation greatly depends on the temperature of the dyeing fluid, the temperature is controlled pursuant to the comparison of the transparencies in the dyeing fluid and the reference fluid. If the reference fluid is more transparent than the dyeing fluid, then heat is applied to the latter; when the difference is reduced, the heat supply is throttled. If the transparency is the same in both fluids or if the dyeing fluid is even more transparent, then it will not receive any more heat.

By this continuous control, the dyeing fluid always has a temperature guaranteeing an optimum attaching process.

The absorption speed of all color components in the textile material is controlled by a change of concentration of the reference fluid from 100 to 0%. In view of the fact that the thickness and the concentration are equivalent or proportional values, a pencil of rays penetrates the vessel containing the reference fluid at different thicknesses corresponding to the concentrations. The vertical rate of motion of the vessel relative to the pencil of rays thus controls the attaching speed.

In a preferred embodiment, the pencil of rays penetrating the fluids are directed to photo-electric receivers, whose outputs are transmitted to amplifiers. The output signal of one amplifier controls the motion of the vessel containing the reference fluid, and that of the other amplifier controls the energy or heat supply to the dyeing vessel via control valves. Preferably steam is used as the heating source.

The apparatus of the invention also has the advantage that intensity variations of the light source do not influence the dyeing process, since the light beams penetrating the fluids emanate from a single source.

In an alternate embodiment, only the alternating current components of the potentials taken from the photo-electric receivers are processed in order to eliminate errors due to any drift of the amplifiers. A threshold value discriminator is connected to the circuit controlling the speed of the vessel with the reference fluid, so that the motion of this vessel is interrupted when the transparency through it becomes greater than through the shunt circuit of the dyeing vat.

In order to eliminate any errors due to dispersion influences dependent upon temperature, the reference fluid and the dyeing fluid may be kept at the same temperature.

DESCRIPTION OF THE PREFERRED EMBODIMENTS

Figure 1:
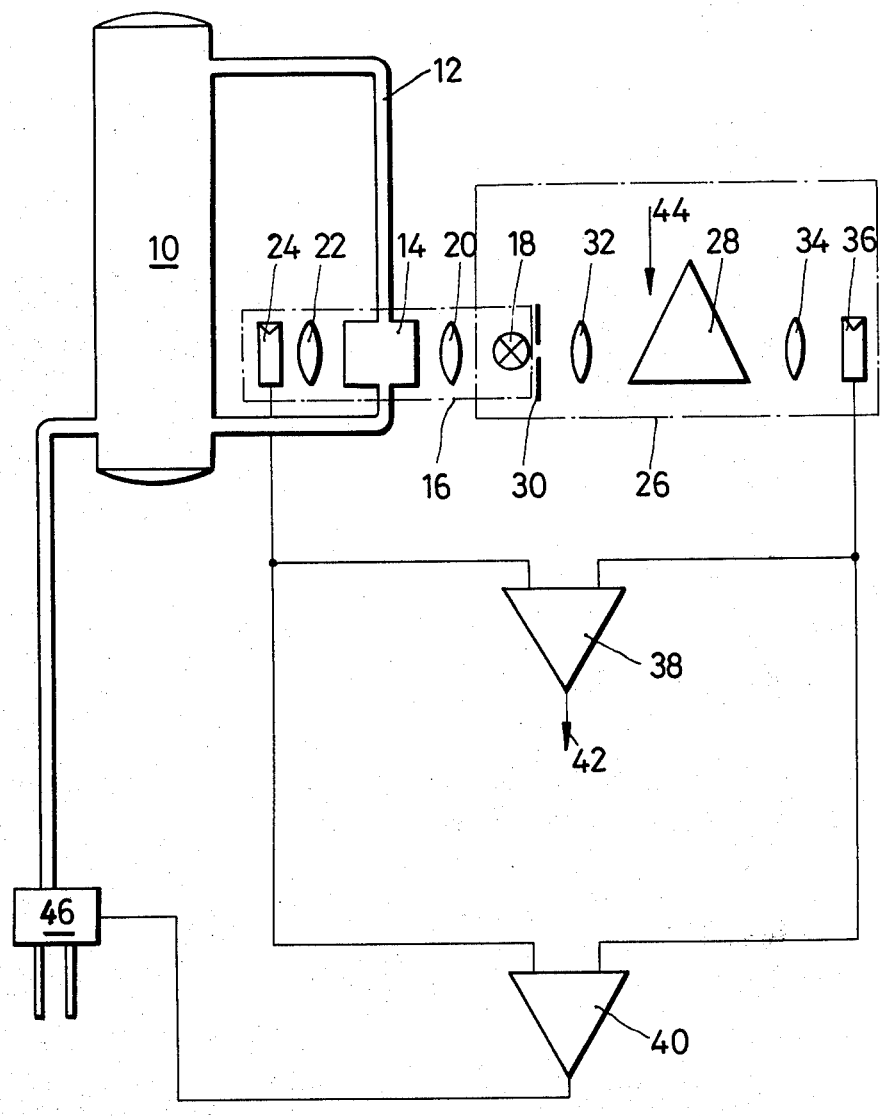
FIG. 1 is a schematic diagram of a control device for dyeing fluids according to a first embodiment of the invention.

FIG. 1 shows schematically the arrangement of a device to control the attaching to or absorption by textile goods of color components existing in a dyeing fluid. The textile goods are placed in a dyeing vat 10 filled with the dyeing fluid. Connected to the dyeing vat 10 is a shunt circuit 12, through which the dyeing fluid flows due to the pressure difference at the connection openings of the dyeing tank 10. In order to attain a high flow speed, a pump can be arranged in the circuit 12 (not shown).

A transparent portion 14 of the circuit 12 is connected to a measuring head 16 composed of a light source 18, lenses 20 and 22 and a photo-electric receiver 24. A pencil of rays emanating from the light source 18 and made parallel by the lens 20, passes through the transparent portion 14 of the circuit 12 and by means of the lens 22 is directed to the photo-electric receiver 44. In a measuring device 26 there is a vessel 28 of triangular section and preferably wedge-shaped configuration, a slit 30, lenses 32, 34 and a photo-electric receiver 36. The vessel 28 is filled with a portion of the dyeing fluid which serves as a reference fluid. The light emanating from the light source 18 is closely limited by the slit 30, made parallel by the lens 32, subsequently penetrates the vessel 28 filled with the reference fluid, and is finally focused by the lens 34 onto the photo-electric receiver 36.

The photo-electric receivers 24 and 36 each are connected to the inputs of amplifiers 28 and 40, which have, e.g., amplification factors of 1000 and 10, respectively. The amplifier 38 at its output supplies a potential which actuates an electric drive 42 (not shown) in order to move the vessel 28 in the direction of the arrow 44. The electric drive 42 and the motion speed of the vessel 28 connected therewith can be adjusted in such a manner that the vessel 28, within the desired dyeing time, vertically moves relative to the ray emanating from the light source 18 from the base to the top. The output voltage supplied by the amplifier 40 continuously controls an arrangement 46 composed of control valves (not shown in detail), serving to transfer heat, preferably by means of steam, to the dyeing vessel to control its temperature. Further heating and cooling lines can also be connected to the arrangement 46.

At the beginning of the attaching operation, by means of electric switching (not shown) or a mechanical adjustment of the vessel 28, the potentials emanating from the photo-electric receivers 24 and 36 are balanced in such a manner that no potentials exist at the outputs of the amplifiers 38 and 40. Simultaneously the heating of the dyeing fluid is started. With increasing temperature the concentration of the dyeing fluid decreases. This causes a change of the transparency and thus a change of voltage at the output of the photo-electric receiver 24. When the potential taken from the photo-electric receiver 24 exceeds that of the photo-electric receiver 36, then the amplifier 38 supplies an output pulse which switches on the electric drive 42 (not shown), and the vessel 28 moves in the direction of decreasing thickness. At the same time the amplifier 40 supplies a negative output voltage which acts upon the arrangement 46 in such a manner that the control valve for the steam supply to the dyeing vessel 10 are closed, which prevents a further increase of the temperature.

Since the vessel 28 moves in the direction of decreasing thickness, the reference fluid vessel becomes more transparent because the thickness and the concentration are proportional values. The potential taken from the photo-electric receiver 36 thereby increases and finally exceeds that of the photo-electric receiver 24, so that at the output of the amplifier 40, depending on the voltage difference at the input, a positive voltage is developed. The latter influences the control valves of the arrangement 46 and causes an adjustment of the temperature to a value permitting an optimum attaching process. The concentration in the dyeing vessel 10 is therefore reduced, the voltage taken from the photo-electric receiver 24 is increased, the voltage difference at the inputs of the amplifier 40 changes in such a manner that the output pulse becomes less or even negative, and the control valves will thus be throttled or closed. An opening of the control valves and a temperature increase again takes place when the light ray admitted to the photo-electric receiver 36 penetrates the vessel 28 through a smaller thickness, so that its potential becomes higher than that of the photo-electric receiver 24.

By this continuous changing of the steam supply and the change and adjustment of temperature connected therewith, the attaching process takes place under optimum conditions. By the constant comparison of the transparency in the dyeing fluid and the reference fluid, the concentration of the dyeing fluid is kept in correspondence with the trans-illuminated thickness of the reference fluid. The attaching speed itself is predetermined by the electric drive 42 and the moving speed of the vessel 28 connected therewith.

If the two intensities are in equilibrium, the drive is stopped until a difference has again developed.

After the vessel 28 has vertically passed the pencil of rays emanating from the light source 18, the dyeing process is completed and the control valves are closed by a switch (not shown), independently of the potential at the output of the amplifier 40.

Figure 2:
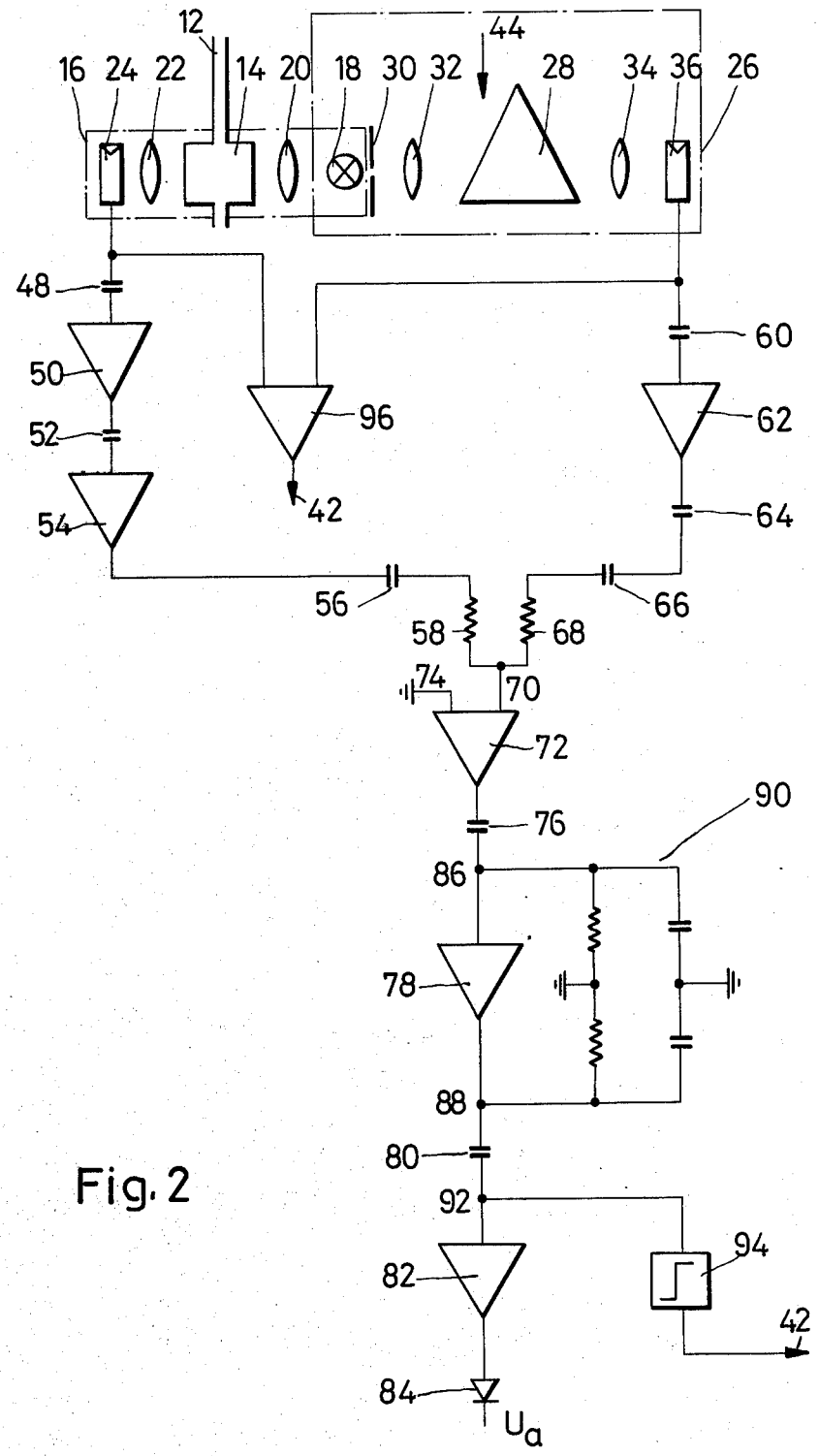
FIG. 2 shows a second embodiment of a control device for dyeing fluids.

In an alternate embodiment according to FIG. 2 only the alternating current components of the potentials discharged by the photo-electric receivers 24, 36 are processed, in order to eliminate any possible errors caused by amplifier drift. Connected in series after the photo-electric receiver 24 are a condenser 48, an amplifier 50, a condenser 52, an inverting amplifier 54, a condenser 56 and a resistor 58; after the photo-electric receiver 36 there are connected in series a condenser 60, an amplifier 62, condensers 64, 66 and a resistor 68.

The potential differences taken from the circuits of the photo-electric receivers 24, 36 are led to an input 70 of a difference amplifier 72. The input 74 of the difference amplifier 72 is coupled to the ground.

Connected in series after the difference amplifier 72 are a condenser 76, an amplifier 78, a condenser 80, an amplifier 82 and a rectifier 84. A potential $U_a$ taken from the rectifier 84 serves to regulate the control valves of the arrangement 46 for setting the temperature in the dyeing fluid at such values as to achieve an optimum attaching process.

A Wien bridge 90 is connected in parallel to the amplifier 78 via connection points 86, 88, in order to process only potentials of a frequency corresponding to the frequency of the light source 18.

The potential taken from a connection point 92 is led to a threshold valve discriminator 94, to the output of which the electric drive 42 is connected.

The photo-electric receivers 24, 36 at the same time are each connected to an input of a difference amplifier 96, whose output potential co-controls the electric drive 42.

At the beginning of the control operation, the vessel 28 is displaced in the direction of reduced thickness, so that the transparency through the vessel becomes greater than through the dyeing fluid. The potential $U_a$ taken from the rectifier 84 influences the control valves of the arrangement 46 and causes the heating of the dyeing fluid. The control valves of the arrangement 46 can be configured as proportional valves, so that the energy supplied to the dyeing fluid through these valves is proportional to the potential $U_a$.

The electric drive 42 is then shut down, since a potential other than 0 is admitted to the threshold value discriminator 94 and the potential of the difference amplifier 96 is positive. Only when the transparency of the reference fluid equals that of the dyeing fluid, namely when no output potential is present at the difference amplifier 72 and the threshold value discriminator 94 does not receive any potential, the electric drive 42 is energized so that the vessel 28 is moved in the direction of reduced layer thickness. Then the above described control operation starts again.

A negative output potential of the difference amplifier 96 causes the electric drive 42 of the vessel 28 to operate independently of the potential at the input of threshold value discriminator 94. This will happen on faulty operation of the control device, if the transparency in the dyeing fluid becomes greater than that in the vessel 28.

In all other respects the control operation according to the embodiment of FIG. 2 corresponds to that of the embodiment of FIG. 1.

The embodiment of FIG. 2 can be modified in such a manner that the alternating current components of the signals from the photo-electric receivers 24, 36 can be separately fed to the inputs 70, 74 of the difference amplifier 72.

What is claimed is:

1. An apparatus for optimally controlling the attachment of at least one color component in a dyeing fluid to textile goods by regulating the temperature of the dyeing fluid as a function of its transparency, comprising:

a. a light source,
b. means for directing light from the source through the dyeing fluid,
c. a first photocell positioned to detect light passing through the dyeing fluid,
d. a transparent container of varying width containing a reference fluid,
e. means for directing light from the source through the reference fluid,
f. a second photocell positioned to detect light passing through the reference fluid,
g. first and second differential amplifiers,
h. means connecting the outputs from each of the photocells to the inputs of each of the amplifiers,
i. means for moving the container transverse to the light passing through it,
j. means for supplying heat to the dyeing fluid,
k. means coupling the output from the first amplifier to the moving means, and
l. means coupling the output from the second amplifier to the heat supplying means.

2. An apparatus according to claim 1 wherein the alternating current components of the photocell outputs are coupled to the second amplifier and the direct current components of the photocell outputs are coupled to the first amplifier.

3. An apparatus according to claim 1 wherein the reference fluid container is moved at a predetermined speed in the direction of reduced width, and thereby controls the attaching speed of all color components contained in the dyeing fluid to the textile goods.

4. An apparatus according to claim 1 wherein the container is wedge-shaped and is filled with a portion of the dyeing fluid having a composition determined prior to the attaching operation.

5. An apparatus according to claim 1 wherein the reference fluid is maintained at the same temperature as the dyeing fluid.

6. An apparatus according to claim 1 wherein the heat supplying means comprises control valves for supplying heat to regulate the temperature of the dyeing fluid.

7. An apparatus according to claim 1 wherein the heat supplying means further includes cooling means.

8. An apparatus according to claim 1 wherein an alternating voltage of a frequency corresponding to that of the light source, taken from the output of the second amplifier, is rectified before being coupled to the heat supplying means.

9. An apparatus according to claim 1 further comprising a threshold value discriminator coupled to the output of the second amplifier for co-controlling the moving means.

10. An apparatus according to claim 1 wherein the reference fluid container is moved in the direction of reduced width only when the transparency through it equals that through the dyeing fluid.

* * * * *